United States Patent [19]

Yano et al.

[11] Patent Number: 4,643,687

[45] Date of Patent: Feb. 17, 1987

[54] MARINE PROPULSION UNIT

[75] Inventors: Kazuhiko Yano, Toyonaka; Kazuhiko Ohtsuki, Takarazuka; Takao Awaya, Iwakuni; Gen Yoshii, Amagasaki, all of Japan

[73] Assignee: Kanzako Kokyukoki Mfg. Co., Ltd., Inadera, Japan

[21] Appl. No.: 702,262

[22] Filed: Feb. 15, 1985

[30] Foreign Application Priority Data

Mar. 8, 1984 [JP] Japan ..... 59-44682

[51] Int. Cl.[4] ..... B63H 23/06

[52] U.S. Cl. ..... 440/75; 440/83; 440/86; 74/416

[58] Field of Search ..... 440/49, 75, 78, 83, 440/84, 86, 111, 112; 74/416, 417

[56] References Cited

U.S. PATENT DOCUMENTS

| | | | |
|---|---|---|---|
| 2,130,125 | 9/1938 | Fromm | 440/83 |
| 2,282,612 | 5/1942 | Schultz | 440/4 |
| 2,521,368 | 9/1950 | Hingerty | 440/83 |
| 3,570,319 | 3/1971 | Arnold | 74/416 |
| 3,937,093 | 2/1976 | Johnson et al. | 440/78 |
| 4,121,532 | 10/1978 | Coryell | 440/83 |
| 4,188,833 | 2/1980 | Krauss et al. | 74/417 |
| 4,303,400 | 12/1981 | Yano et al. | 74/416 |

FOREIGN PATENT DOCUMENTS

| | | | |
|---|---|---|---|
| 2303723 | 6/1974 | Fed. Rep. of Germany | 440/83 |
| 22191 | 5/1921 | France | 440/83 |
| 76793 | 7/1976 | Japan | 440/83 |
| 51698 | 4/1980 | Japan | 440/83 |
| 59098 | 5/1980 | Japan | 440/83 |
| 156796 | 12/1980 | Japan | 440/83 |
| 1226358 | 3/1971 | United Kingdom | 440/83 |
| 1266840 | 3/1972 | United Kingdom | 440/83 |

*Primary Examiner*—Trygve M. Blix
*Assistant Examiner*—Stephen P. Avila

[57] ABSTRACT

A marine propulsion unit having an engine (13) mounted with the output end directed toward the stern of a boat is disclosed in which a required inclination of propeller shaft (15) is provided outside a reversing clutch mechanism (17) by an intermediate shaft (32) and a pair of meshing bevel gears (38, 39) incorporated in the transmission path. The bevel gears (38, 39) are fixedly mounted on either of output shaft (21) or input shaft (20) of the clutch mechanism (17) and the intermediate shaft (32) among which one of the shafts taking a rearer position is inclined relative to the other shaft downwardly and backwardly. These two shafts are disposed relative to each other so that opposed ends thereof take substantially a same level. The propulsion unit permits a low level mounting of engine and may be manufactured with a low cost while permitting to employ a reversing clutch mechanism in boats having different layouts of propulsion unit.

8 Claims, 8 Drawing Figures

27
20
30
19
22
26
37
36
35
34
32
18b
39
18
18a
38
D
θ
α
33
42
41
40
29
31
31b
31a
21
28
17
24
13
23
25
III

MARINE PROPULSION UNIT

FIELD OF THE INVENTION

This invention relates to a marine propulsion unit for use in boats such as pleasure boats including yachts and motor boats.

More particularly, the present invention relates to a marine propulsion unit of the type comprising an engine mounted in the hull of a boat at a stern portion with the output end directed towards the stern, an inclined propeller shaft extending downwardly and backwardly from the hull and carrying at its terminal end a propeller, and a reversing clutch mechanism disposed between said engine and propeller shaft and having an input shaft drivenly connected to said engine and an output shaft drivingly connected to said propeller shaft.

DESCRIPTION OF PRIOR ART

In general, marine propulsion unit of the type set forth above is called an angle drive system. A standard type of such angle drive system is fashioned so that the whole of propulsion unit from engine to propeller shaft via a reversing clutch mechanism is mounted in a posture inclined downwardly and backwardly by an angle equal to an inclination angle to be given to the propeller shaft. Such standard type propulsion unit is disclosed in, by way of examples, British Pat. No. 1,226,358 and German Offenlegungsschrift No. 2,303,723.

It is always required or preferred to enlarge crew space in a boat such as pleasure boat. In a boat having an angle drive system of the standard type, height of engine room is enlarged due to the inclined posture of engine corresponding to the downward and backward inclination of propeller shaft so that crew space is reduced correspondingly. From this, there have been proposed some propulsion units of angle drive type in which engine is mounted horizontally so as to enlarge crew space within the hull of a boat.

One of such structures according to the prior art is such in that, as shown in, for example, FIGS. 3 and 6 of JP, A (Japanese Patent Publication under Art. 65 bis of the Japanese Patent Law) No. 51,76793, engine and reversing clutch mechanism are disposed horizontally and the inclined propeller shaft is drivenly connected to the output shaft of reversing clutch mechanism by means of transmission shaft having at both ends thereof universal joints. According to this prior art, however, the whole of propulsion unit is enlarged considerably in length in the longitudinal direction of boat due to the use of not only an intermediate transmission shaft but a pair of universal joints at the ends of such shaft. This drawback is enhanced when a pair of universal joints of constant velocity type are employed for a smooth drive of the propeller shaft, because such constant velocity universal joints provide bulky joint structures. Constant velocity universal joint is relatively expensive so that use of a pair of such universal joints is not preferred.

Another use of constant velocity universal joint in an angle drive system is shown in FIGS. 13 and 14 of JP, A No. 55-51698. In the propulsion unit according to this prior art engine and reversing clutch mechanism are disposed horizontally, too. A transmission shaft extending downwardly and backwardly as from a position below the rear end portion of output shaft of the reversing clutch mechanism is provided coaxially with propeller shaft and is fixedly connected to such propeller shaft. This intermediate transmission shaft mounts rotatably at its front end portion a spur gear which is meshed with another spur gear fixedly mounted on the rear end portion of clutch output shaft. A constant velocity universal joint of Birfied-type is disposed within the former spur gear and on the intermediate transmission shaft for connecting operatively such spur gear and transmission shaft. The marine propulsion unit according to this prior art employs a single constant velocity universal joint which is disposed within a gear so that the propulsion unit is made compact and may be manufactured with a relatively low cost. On the other hand, the intermediate transmission shaft having a downward and backward inclination is located below the clutch output shaft so that power transmission path includes a step or stepped portion at a bend from which such path is inclined. Such step or stepped portion which lowers the level of transmission path at the bend thereof requires to highten the level of clutch output shaft and, therefore, the level of reversing clutch mechanism and engine so that crew space is reduced correspondingly.

As another prior art which provides an inclination in the power transmission path from engine to propeller shaft for the angle drive system while the engine is mounted horizontally, use of bevel gears has been proposed.

An example of such prior art is shown in FIGS. 14 and 15 of JP, A No. 55-156796. In a marine propulsion unit according to this prior art, engine and reversing clutch mechanism are mounted horizontally but the clutch mechanism is disposed so that output shaft extends vertically and is projected downwardly from the clutch mechanism. An inclined intermediate shaft which is aligned coaxially with propeller shaft and is fixedly connected to such propeller shaft is provided and is drivenly connected to the clutch output shaft by meshing a pair of bevel gears fixedly mounted on these shafts. In the propulsion unit according to this prior art, the reversing clutch mechanism and transmission located below such clutch mechanism and having the pair of bevel gears occupy a large space in the vertical direction so that level of the clutch mechanism and, therefore, the level of engine are hightened. This will result in a reduction of crew space, too.

Use of conical gear for providing a downward and backward inclination in the power transmission path is shown in FIGS. 1 to 6 of U.S. Pat. No. 3,570,319. In the marine propulsion unit according to this U.S. patent, output shaft of fluid-actuated reversing clutch mechanism which is powered from a horizontally mounted engine is inclined so as to align coaxially with propeller shaft and is fixedly connected to such propeller shaft. On the clutch output shaft is fixedly mounted a conical gear which is in constant mesh with forward direction and backward direction gears respectively mounted on forward direction and backward direction shafts. The forward direction and backward direction gears are connected selectively to forward direction and backward direction shafts by an operation of fluid-actuated forward direction and backward direction clutches, respectively. This structure will reduce mounting space for the propulsion unit in the longitunal direction of a boat as well as in the vertical direction of such boat so that an enlarged crew space may be secured. With respect to pleasure boats and similar boats, it is, however, often true that mounting positions and postures of the engine and clutch as well as the inclination angle of propeller shaft are decided when designing the hull of a boat. From this, there are various boats to be equipped with angle drive system. That is, some boats are predetermined to mount the engine and reversing clutch mechanism in an inclined posture and another boats are predetermined to mount the engine in a horizontal posture. Further, the inclination angle of propeller shaft is predetermined variously. In the marine propulsion unit disclosed in the above-stated U.S. Pat. No. 3,570,319, the clutch output shaft is inclined downwardly and backwardly by an angle while the forward direction shaft which also acts as clutch input shaft and the backward direction shaft are disposed horizontally. It is thus seen that a reversing clutch mechanism having the structure according to this U.S. patent may be equipped only in a boat which is designed to mount the engine horizontally and to incline the propeller shaft by a given angle corresponding to the inclination angle of clutch output shaft. This means that such reversing clutch mechanism must be designed from boat to boat having predetermined various layouts, that is disadvantageous in economical respects. Clutch casing which journals the inclined output shaft must be varied when the inclination angle of such output shaft is varied.

OBJECT

Accordingly, a primary object of the present invention is to provide a novel marine propulsion unit of the type set forth at the beginning which permits to mount engine in the hull of a boat at a low level horizontally and may be manufactured with a low cost while permitting to employ a reversing clutch mechanism in boats having different layouts with respect to the inclination angle of propeller shaft as well as the mounting posture of engine.

SUMMARY OF THE INVENTION

The present invention relates to a marine propulsion unit comprising an engine mounted in the hull of a boat at a stern portion with the output end directed towards the stern, an inclined propeller shaft extending downwardly and backwardly from the hull and carrying at its terminal end a propeller, and a reversing clutch mechanism disposed between said engine and propeller shaft and having an input shaft drivenly connected to said engine and an output shaft drivingly connected to said propeller shaft, and is characterized in that an intermediate shaft located outside said reversing clutch mechanism is incorporated in the power transmission path between said engine and propeller shaft in a fashion such that, among said intermediate shaft and one of said input shaft and output shaft, a second shaft taking a rearer position extends relative to a first shaft taking a fronter position downwardly and backwardly as from the front end of said second shaft which end is located at a level substantially same with that of the rear end of said first shaft, said first shaft being connected drivingly to said second shaft by meshing a first bevel gear fixedly mounted on a rear end portion of said first shaft with a second bevel gear fixedly mounted on a front end portion of said second shaft.

That is, the marine propulsion unit according to the present invention is fashioned such that an intermediate shaft is disposed between the clutch output shaft and propeller shaft so as to provide a bend towards a downward and backward direction to the power transmission path between such output shaft and intermediate shaft or such that an intermediate shaft is disposed between the engine and clutch input shaft so as to provide a bend towards a downward and backward direction to the power transmission path between such intermediate shaft and input shaft. In the case when the intermediate shaft is disposed between the engine and clutch input shaft, the inclination to be given to the clutch input shaft which is now the above-recited second shaft relative to the intermediate shaft which is now the above-recited first shaft may be given by disposing the reversing clutch mechanism in a posture downwardly and backwardly inclined by an angle equal to the inclination angle to be given to the input shaft.

When the first shaft is disposed horizontally and the second shaft is inclined downwardly and backwardly by an angle equal to the inclination angle to be given to the propeller shaft, the inclination angle to be given to the propeller shaft is provided between the first and second shafts so that engine is mounted in a horizontal posture. It is thus seen that the marine propulsion unit according to the present invention permits to mount the engine horizontally.

Because the front end of second shaft taking a rearer position is located at a level substantially same with the level of first shaft taking a fronter position and because the required connection between such first and second shafts is achieved by meshing first and second bevel gears fixedly mounted on these shafts at the opposed end portions thereof, a bend in the power transmission path is located approximately at the rear end of the first shaft the level of which end is substantially equal to that of the front end of the second shaft. It is thus seen that the power transmission path does not include at such bend a step or stepped portion which lowers the level of the transmission path than the level of first shaft. Owing to such bend which provides substantially no step or stepped portion in the power transmission path, the marine propulsion unit according to the present invention does not require to give a large difference in levels between the engine and propeller shaft so that it permits to mount engine in the hull of a boat at a low level.

In the marine propulsion unit according to the present invention, a required inclination in the transmission path corresponding to the inclination of propeller shaft is provided outside the reversing clutch mechanism by using a single intermediate shaft and a pair of bevel gears. This structure is simpler than a structure that a required inclination in the power transmission path is provided by a pair of constant velocity universal joints which are large in number of parts. The structure according to the present invention that a required inclination or bend in the power transmission path is provided outside the reversing clutch mechanism permits to employ a reversing clutch mechanism in a boat in which engine is mounted horizontally or approximately horizontally and in another boat in which engine is mounted in a posture inclined by an angle equal to the inclination angle of propeller shaft. Adjustment or change of the inclination angle of propeller shaft to a given or predetermined value may be achieved by varying holder means for the intermediate shaft as well as the pair of bevel gears while the reversing clutch mechanism is used as it is.

The pair of meshing bevel gears mounted on the first and second shafts which are opposed with each other at their ends are in face to face relationship with other. Each of such bevel gears may have a small cone distance so that these bevel gears may be manufactured by using a conventional machine with a low cost. A pair of bevel gear each having a large distance such that are used for bending the power transmission path in a marine V-drive system disclosed in, for example, U.S. Pat. Nos. 2,130,125 and 2,282,612 requires a very large machine for manufacturing such gears and are expensive.

As described before, the engine may be mounted horizontally by disposing the second shaft in a posture inclined by an angle equal to the inclination angle to be given to the propeller shaft while the first shaft is disposed horizontally. A required inclination of the propeller shaft may, however, also be given by a combination of an inclination of the engine and an inclination or bend provided in the power transmission path.

An embodiment of the present invention is thus fashioned such in that the engine is mounted in a posture inclined downwardly and backwardly by an inclination angle, said inclination angle of engine and inclination angle of the second shaft relative to the first shaft being predetermined so that sum of these inclination angles is equal to the inclination angle to be given to the propeller shaft. According to this structure, the inclined engine will enlarge the engine room resulting in a reduction of crew space in a boat. In a case where such structure is employed in a boat having a propeller shaft of relatively large inclination angle, however, the inclination angle of engine may be much smaller than that of the propeller shaft so that reduction of crew space due to the inclined engine may be much smaller when compared to the standard type propulsion unit in which engine is inclined by an angle equal to the inclination angle of propeller shaft.

In the marine propulsion unit according to the present invention, an inclination or bend in the power transmission path is provided between either of the clutch output shaft or input shaft and the intermediate shaft and, for providing such inclination or bend, a bevel gear is fixedly mounted on an end portion of the clutch output shaft or input shaft. It is preferred that such bevel gear on either of clutch output shaft or input shaft is formed separately from the shaft and is fixedly mounted on the shaft using a removable fastening means, because this kind of bevel gear permits to mount a coupling means on the end portion of the shaft immediately in place of the bevel gear when a reversing clutch is intended to be employed in a boat having another layout of propulsion unit.

On the other hand, the second or first bevel gear fixedly mounted on the intermediate shaft is preferred to be such that is formed integrally with the intermediate shaft. This is because such integral bevel gear contributes not only to an easier assemblage by omitting a fastening process but to a closer arrangement of the clutch output or input shaft and intermediate shaft by eliminating fastening means for the bevel gear between such two shafts. Such closer arrangement of the two shafts in turn contributes to a reduction of axial thickness of the meshing first and second bevel gears which are mounted on the opposed end portions of the two shafts.

BRIEF DESCRIPTION OF THE DRAWINGS

Another features of the present invention and its attendant advantages will become readily apparent from the descriptions of the embodiments shown in the drawings in which.

DESCRIPTION OF PREFERRED EMBODIMENTS

Figure 5:
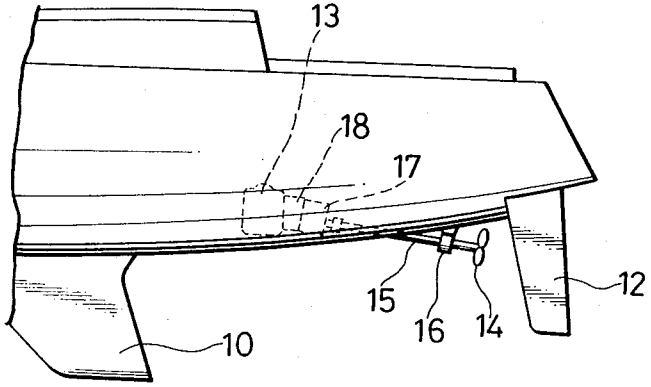
FIG. 5 is a schematic side elevational view of part of a boat in which a second embodiment of the marine propulsion unit according to the present invention is employed.

Referring now to the drawings in which like numerals designate like parts throughout, there is shown in FIGS. 1 to 4 a first preferred embodiment of the marine propulsion unit according to the present invention.

Figure 1:
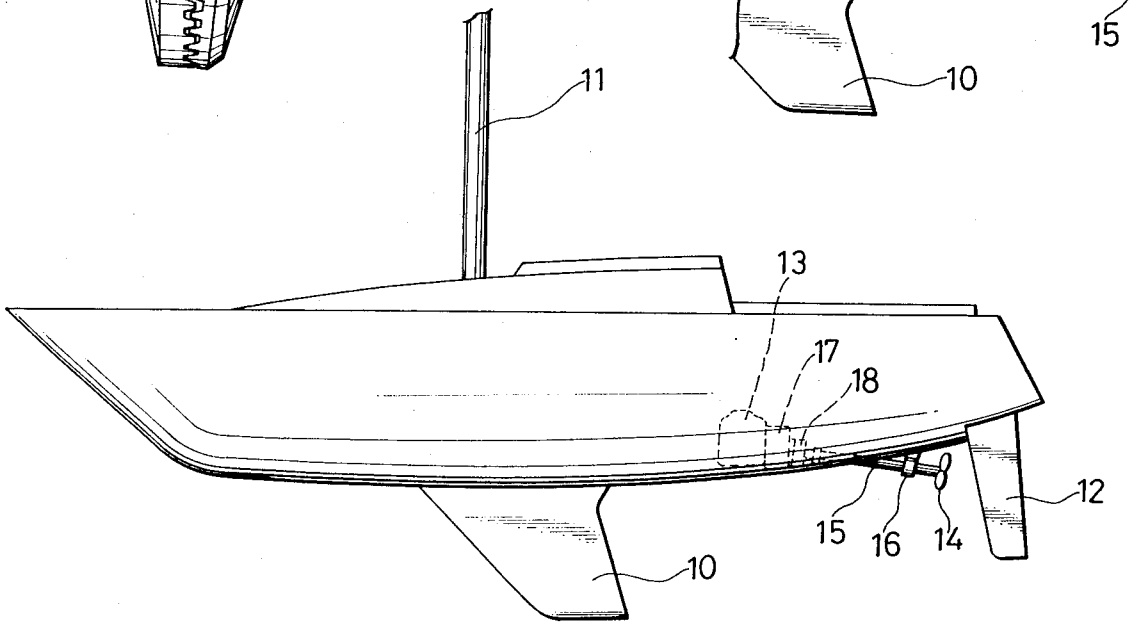
FIG. 1 is a schematic side elevational view of a boat in which a first embodiment of the marine propulsion unit according to the present invention is employed.

In a yacht or pleasure boat shown in FIG. 1 having a center board 10 at the bottom for stabilizing the boat, a mast 11 on the deck and a rudder 12 at the stern for steering the boat, an engine 13 is mountd at a stern portion substantially in a horizontal posture so that its output end is directed towards the stern. Propeller 14 which directly propels the boat is carried by an inclined propeller shaft 15 extending downwardly and backwardly from the bottom of the hull. The propeller shaft 15 is journaled at a portion adjacent to the terminal end thereof by a shaft bracket 16 on the bottom of the hull. To the output end of engine 13 is attached a reversing clutch mechanism 17 to which a transmission casing 18 of a small size is in turn attached at the output end of such clutch mechanism. Power from the engine 13 is transmitted to the propeller shaft 15 through the reversing clutch mechanism and through transmission within the transmission casing 18.

Figures 2, 3:
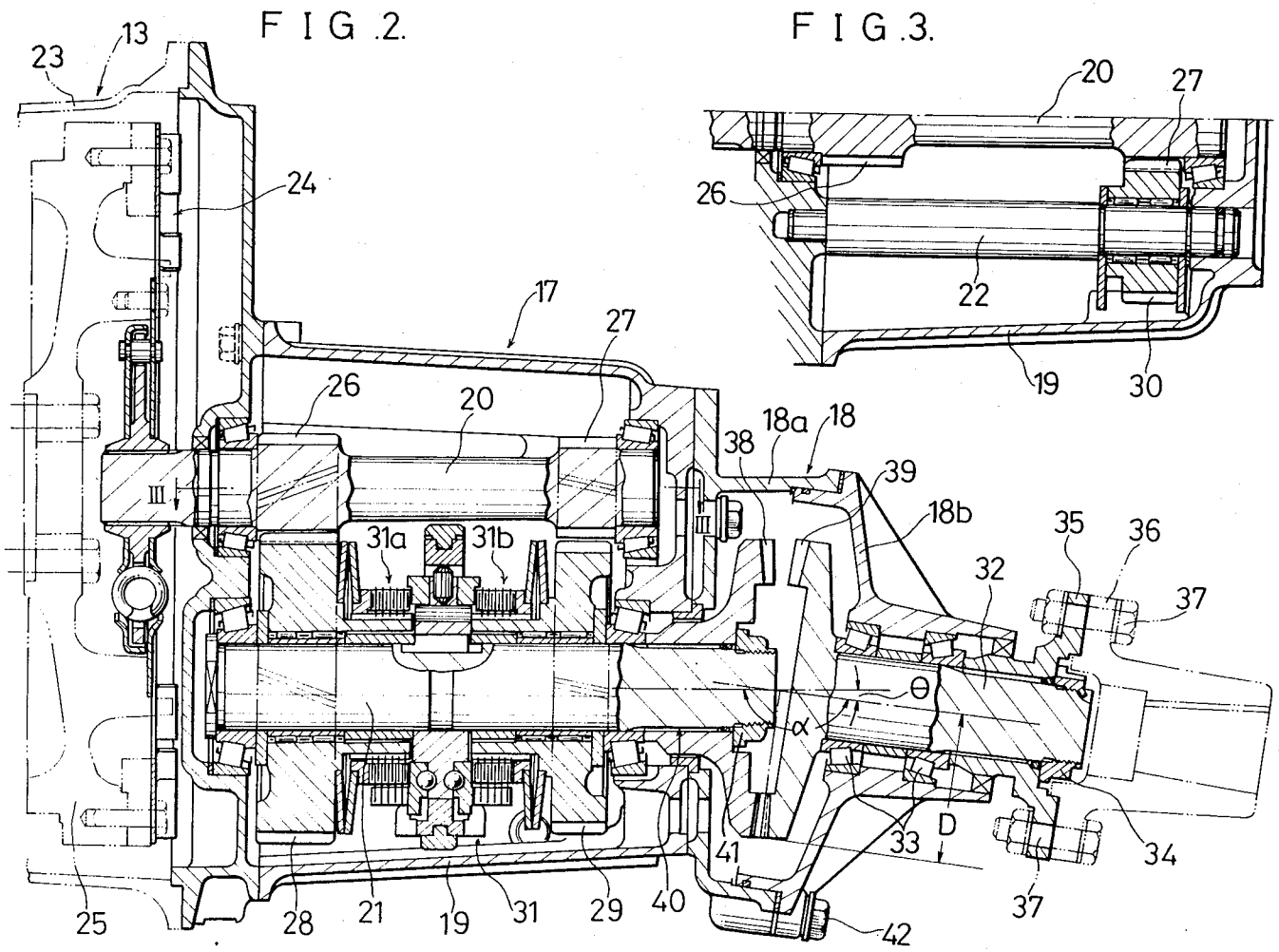
FIG. 2 is a sectional side view showing an essential part of the propulsion unit shown in FIG. 1.
FIG. 3 is a sectional view, partially omitted, taken along line III—III of FIG. 2, showing a part of reversing clutuch mechanism shown in FIG. 2.

As shown in FIG. 2, the reversing clutch mechanism 17 comprises an input shaft 20 extending forwardly from a clutch casing 19 for the clutch mechanism, an output shaft 21 extending backwardly from the clutch casing 19 and an idler shaft 22 shown in FIG. 3 which is journaled within the casing 19. These shafts 20, 21 and 22 are arranged in parallel with one another. In the first embodiment shown in FIGS. 1 to 4, reversing clutch mechanism 17 is attached at its casing 19 to the engine 13 so that the clutch mechanism takes a horizontal posture whereby shafts 20, 21 and 22 extend horizontally. As is usual, the input shaft 20 is connected at the front end thereof to the fly wheel 25 of engine 13 through a damper coupling 24. Within the clutch casing 19, the input shaft 20 is integrally formed with a forward direction gear 26 and backward direction gear 27. On the output shaft 21 are rotatably mounted a forward direction gear 28 and backward direction gear 29 through bearing means. The forward direction gears 26 and 28 are directly meshed with each other, whereas the backward direction gears 27 and 29 are operatively connected by meshing these gears with an idler gear 30 shown in FIG. 3 which is mounted rotatably on the idler shaft 22 through bearing means. The clutch mechanism 17 shown includes a mechanically actuated friction clutch 31 of the type known from, for example, British Pat. No. 1,266,840 which is operated by a selective engagement of forward direction frictional elements 31*a* or backward direction frictional elements 31*b*. Such clutch may be any of another types such as fluid-actuated friction clutch well known to the art. The clutch 31 operates to connect the forward direction gear 28 or backward direction gear 29 selectively to the output shaft 21 so that the shaft 21 is driven to rotate selectively into forward or backward propelling direction.

As also shown in FIG. 2, an intermediate shaft 32 is provided outside the reversing clutch mechanism 17. This intermediate shaft 32 is rotatably supported by a cylindrical rear end portion of the transmission casing 18 through a pair of bearings 33 so that it is inclined backwardly and downwardly by an angle $\theta$ equal to the angle of inclination of the propeller shaft 15 so as to be aligned coaxially with such propeller shaft. On the rear end portion of intermediate shaft 32 is fixedly mounted a coupling half 35 using a spline connection and a nut 34 screwed on the shaft 32. The intermediate shaft 32 is fixedly coupled to the propeller shaft 15 by fastening the coupling half 35 to another coupling half 36 fixedly mounted on the front end portion of propeller shaft 15 by means of fastening means 37.

Figure 4:
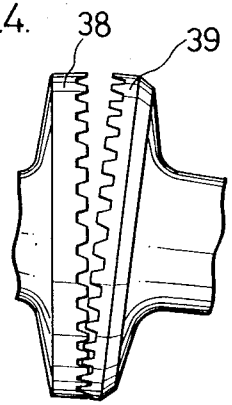
FIG. 4 is a side elevational view of a pair of meshing bevel gears shown in FIG. 2.

The intermediate shaft 32 is disposed relative to the horizontally disposed output shaft 21 of reversing clutch mechanism 17 so that the front end of such intermediate shaft 32 is substantially located at a level equal to the level of the rear end of output shaft 21 so as to be faced substantially to such rear end of the shaft 21. These output shaft 21 and intermediate shaft 32 are operatively connected with each other within the transmission casing 18 by meshing a first bevel gear 38 fixedly mounted on a rear end portion of the shaft 21 with a second bevel gear 39 fixedly mounted on a front end portion of the shaft 32. The first and second gears 38 and 39 a side view of which is shown in FIG. 4 are formed to helical bevel gears so as to reduce noise generated from co-rotation of the meshing gears.

Among the bevel gears 38 and 39, the first bevel gear 38 is mounted on the output shaft 21 using a spline connection 40 and is fixedly fastened to the shaft 21 using a nut means 41 screwed on the output shaft 21. Contrarily, the second bevel gear 39 is formed integrally with the intermediate shaft 32. The transmission casing 18 is formed by a fronter case 18*a* fixedly secured to the rear of clutch casing 19 and a rearer case 18*b* fixedly secured to the former case 18*a* by fastening means 42. The rearer case 18*b* has an inclination along the intermediate shaft 32 and is fitted at the front end thereof into the fronter case 18*a*.

In the marine propulsion unit shown in FIGS. 1 to 4, power is transmitted from the fly wheel 25 of engine 13 to the input shaft 20 of reversing clutch mechanism 17 through damper coupling 24 so that the input shaft 20 is driven to rotate into a direction. By a selective operation of the reversing clutch mechanism 17, the output shaft 21 thereof is driven to rotate selectively into forward or backward propelling direction. Rotation of this output shaft 21 is transmitted from the first bevel gear 38 to the second bevel gear 39 so as to rotate the intermediate shaft 32 so that the propeller shaft 15 and propeller 14 are driven to rotate to cause a propulsion of the boat towards the forward or backward direction.

Owing to the fact that the engine 13 is mounted horizontally and owing to the fact that bend in the transmission path between the clutch output shaft 21 and the intermediate shaft 32 does not have any step which lowers the level of transmission path at such bend so that the level of engine 13 is lowered, a large crew space is secured within the hull. For varying the angle of propellor shaft 15, intermediate shaft 32 and transmission casing 18 supporting such shaft as well as a pair of bevel gears 38, 39 are exchanged in accordance with such inclination angle of propeller shaft and the reversing clutch mechanism 17 shown may be used as it is. Because the second bevel gear 39 is formed integrally with the intermediate shaft 32 so that there is provided between the output shaft 21 and intermediate shaft 32 no fastening means for fastening the second gear 39 to intermediate shaft 32, the rear end of output shaft 21 and the front end of intermediate shaft 32 may be positioned relative to each other as closely as possible whereby it is not required to shape each of the bevel gears 38, 39 to have a large thickness so that these gears project largely towards each other for meshing.

As can be seen from FIG. 2, angle $\alpha$ between axes of the mutually meshed first and second bevel gears 38 and 39 is not equal to the inclination angle $\theta$ to be given to the intermediate shaft 32 but has a value deducted such inclination angle $\theta$ from 180° due to the face to face arrangement of two bevel gears to be meshed. Cone distance D of each of such bevel gears 38, 39 is thus small, as shown in FIG. 2. From this, a pair of bevel gears 38, 39 employed in the propulsion unit according to the present invention may be manufactured with a low cost.

In a boat which is designed previously so as to be equipped with a standard type propulsion unit in which engine 13 is mounted in a posture inclined downwardly and backwardly by an angle equal to the inclination angle of propellor shaft 15, the reversing clutch mechanism 17 may be employed as it is by removing the first bevel gear 38 on the clutch output shaft 21 and by fixedly mounting the coupling half 35 onto the rear end portion of output shaft 21 by means of nut means 34 or 41.

Figure 6:
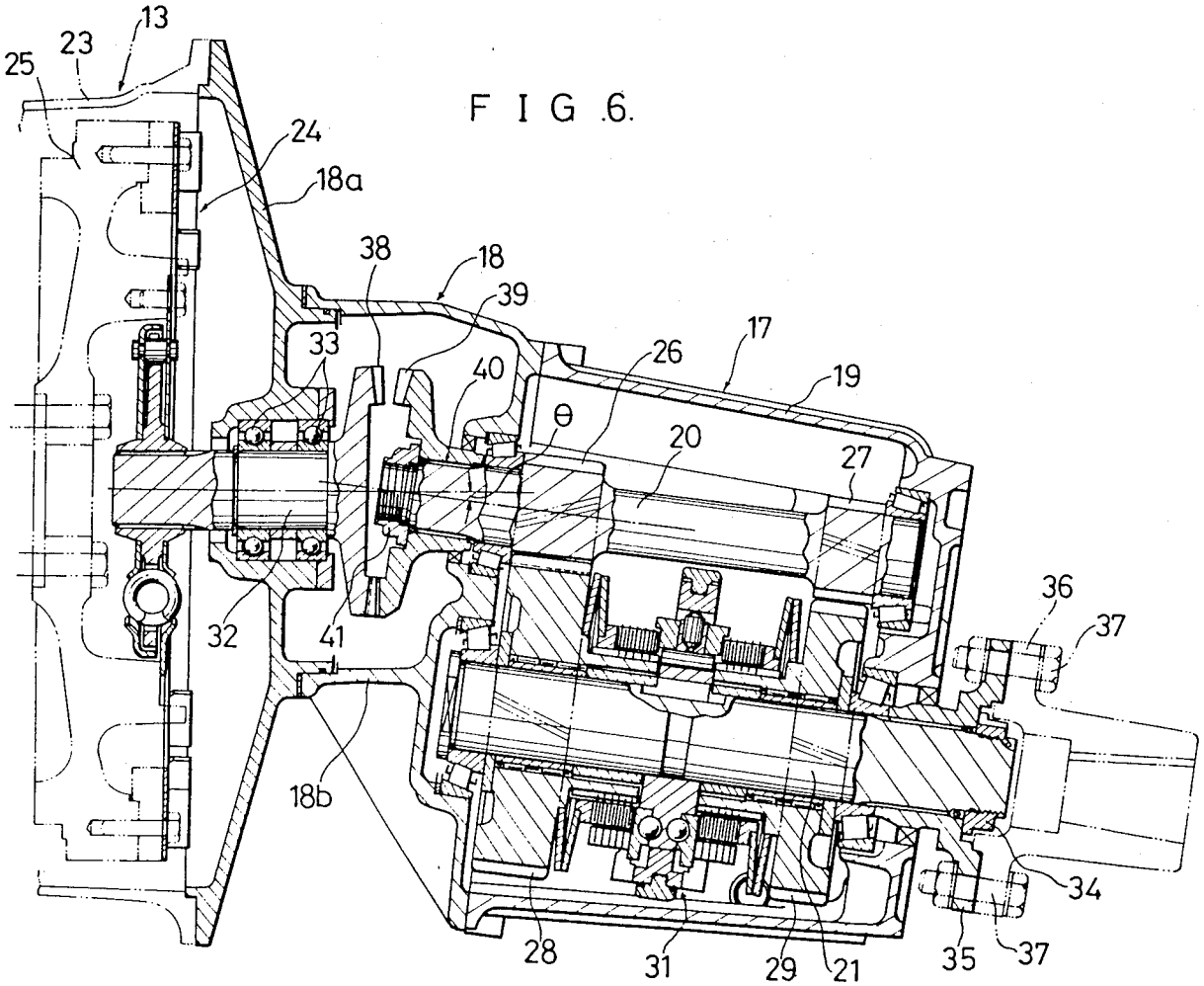
FIG. 6 is a sectional side view showing an essential part of the propulsion unit shown in FIG. 5.

Turning to a consideration of FIGS. 5 and 6, there is shown in these figures a second preferred embodiment of the marine propulsion unit according to the present invention.

In this second embodiment, a transmission casing 18 which corresponds to the transmission casing 18 employed in the first embodiment is disposed between engine 13 and reversing clutch mechanism 17. An intermediate shaft 32 which corresponds to the intermediate shaft 32 employed in the first embodiment is horizontally arranged within such transmission casing 18 and is journalled by the casing 18 through a pair of bearings 33. This intermediate shaft 32 is drivenly connected at the front end portion thereof to the fly wheel 25 of horizontally mounted engine 13 through damper coupling 24.

As shown in FIG. 6, the reversing clutch mechanism 17 is inclined downwardly and backwardly by an angle $\theta$ equal to the inclination angle of propeller shaft 15. This clutch mechanism 17 has a structure similar to that of the clutch mechanism 17 employed in the first embodiment except that a coupling half 35 is fixedly mounted on a rear end portion of the clutch outputshaft 21 using a spline connection and nut means 34. The output shaft 21 is aligned coaxially with the propeller shaft 15 and is fixedly connected to such propeller shaft 15 by fastening the coupling half 35 to another coupling half 36 fixedly mounted on the front end portion of propeller shaft 15 by means of fastening means 37.

The horizontally disposed intermediate shaft 32 and the clutch input shaft 20 which is inclined by an angle $\theta$ equal to the inclination angle of clutch mechanism 17 are disposed relative to each other so that the rear end of intermediate shaft 32 and the front end of input shaft 20 are located substantially at a same level and are opposed with each other. A first spiral bevel gear 38 is formed integrally with the rear end portion of intermediate shaft 32, whereas a second spiral bevel gear 39 is fixedly mounted on a front end portion of the input shaft 20 using a spline connection 40 and a nut 41. These first and second bevel gears 38 and 39 are meshed with each other, as is the case in the first embodiment.

The transmission casing 18 comprises a fronter case 18*a* which also covers the rear end opening of engine casing 23 and a rearer case 18*b* which also covers the front end opening of clutch casing 19. These cases 18*a*, 18*b* are fitted and fixedly connected at their ends.

Compared to the propulsion unit shown in FIGS. 1 to 4, the marine propulsion unit shown in FIGS. 5 and 6 will reduce crew space within the hull by an extent such that the inclined clutch mechanism 17 having a relatively large height will highten the position of engine 13. It is, however, to be noted that the propulsion unit shown in FIGS. 5 and 6 will also enlarge crew space owing to a horizontal mounting of engine 13 and owing a structure for giving a required inclination of propeller shaft 15 which structure includes therein substantially no stepped bend portion. For varying the inclination angle of propeller shaft 15, intermediate shaft 32 and the rearer case 18*b* of transmission casing 18 supporting such shaft as well as a pair of bevel gears 38, 39 are exchanged correspondingly.

For a boat to be equipped with a standard type propulsion unit, the reversing clutch mechanism 17 may be employed as it is by removing the second bevel gear 39 on the clutch input shaft 20 and by fitting the splined front end portion of such shaft 20 into the center hub of damper coupling 24 for a spline connection.

Figure 7:
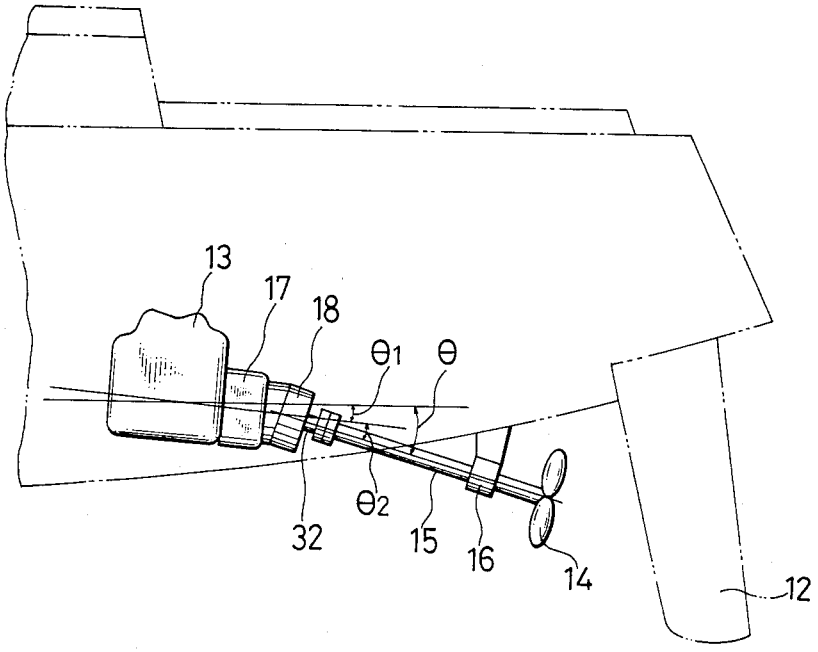
FIG. 7 is a schematic side elevational view of a third embodiment of the marine propulsion unit according to the present invention, showing also part of a boat in which the third embodiment is employed.
Figure 8:
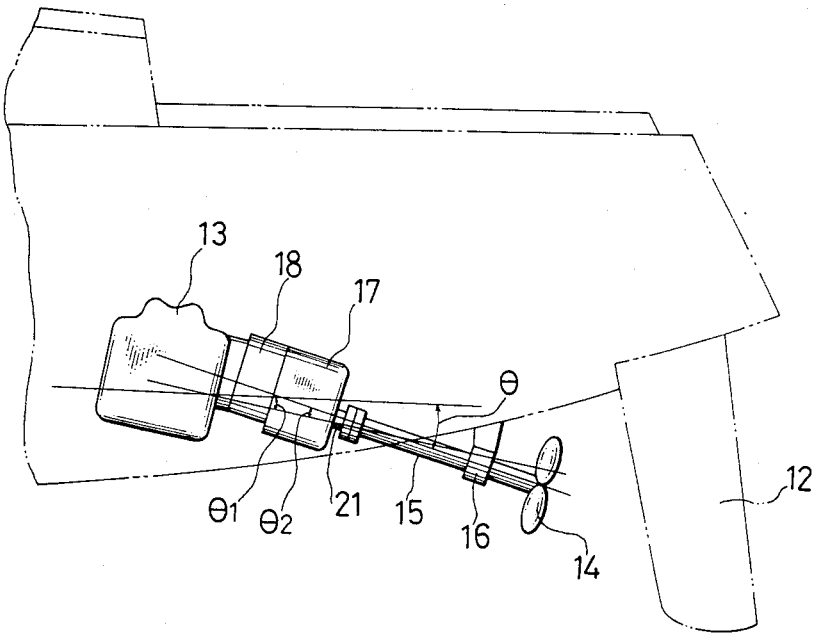
FIG. 8 is a schematic side elevational view similar to FIG. 7, but showing schematically a fourth embodiment of the marine propulsion unit according to the present invention.

In the two embodiments having been detailed hereinbefore, a required downward and backward inclination is given to the propeller shaft 15 only by providing a bend in the power transmission path from engine 13 to the propeller shaft 15. The present invention may, however, be embodied in a fashion such that a required inclination of the propeller shaft 15 is given by a combination of an inclination of the engine 13 and a bend in the transmission path. FIG. 7 and FIG. 8 show a third and fourth embodiments which concern such combination, respectively.

In the marine propulsion unit shown in FIG. 7, propeller shaft 15 is inclined with a relatively large angle $\theta$. Engine 13 is mounted in a posture inclined downwardly and backwardly by a relatively small angle $\theta_1$. To the output end of reversing clutch mechanism 17 is provided a transmission casing 18 which includes a transmission similar to that employed in the first embodiment shown in FIGS. 1 to 4 so as to provide a bend of angle $\theta_2$ between clutch output shaft (not shown) and intermediate shaft 32. The inclination angle $\theta_1$ of engine 13 and the angle $\theta_2$ at the bend of power transmission path are predetermined so that sum of these angles $\theta_1$ and $\theta_2$ is equal to the inclination angle $\theta$ of the propeller shaft 15 ($\theta_1+\theta_2=\theta$).

In the fourth embodiment shown in FIG. 8 in which propeller shaft 15 is inclined with a relatively large angle $\theta$, engine 13 is inclined by a small angle $\theta_1$. Between the engine 13 and reversing clutch mechanism 17 is disposed a transmission casing 18 which includes a transmission similar to that employed in the second embodiment shown in FIGS. 5 and 6, whereby a bend of angle $\theta_2$ is provided in the power transmission path. The required inclination angle $\theta$ of propeller shaft 15 is given by a sum of the angle $\theta_1$ and angle $\theta_2$.

Compared to a standard type propulsion unit in which engine is mounted with a posture inclined by an angle equal to the inclination angle of propeller shaft, each of the marine propulsion units shown in FIGS. 7 and 8 is fashioned so that the engine 13 is inclined by a smaller angle $\theta_1$. Accordingly, such propulsion unit will also enlarge crew space within the hull.

We claim:

1. A marine propulsion unit comprising an engine mounted in the hull of a boat at a stern portion with the output end directed towards the stern, an inclined propeller shaft arranged to extend downwardly and backwardly from the hull and carrying at its terminal end a propeller, and a reversing clutch mechanism disposed between said engine and propeller shaft and having an input shaft drivenly connected to said engine and an output shaft drivingly connected to said propeller shaft, wherein an intermediate shaft (32) is mounted in the transmission path and has its fore end coupled to the aft end of said output shaft (21), the coupled shaft ends being at substantially the same level and coupled together by a pair of meshing external bevel gears (38, 39) fixedly mounted face to face on said shaft ends such that said intermediate shaft is inclined relative to said output shaft downwardly and backwardly, said propeller shaft (15) being aligned coaxially with said intermediate shaft and fixedly connected to the aft end of the said shaft.

2. A marine propulsion unit as claimed in claim 1, wherein said engine (13) and said reversing clutch mechanism (17) are mounted horizontally so that the angle of inclination of said intermediate shaft (32) determines the inclination of said propeller shaft (15).

3. A marine propulsion unit as claimed in claim 1, wherein said engine (13) and said reversing clutch mechanism (17) are mounted in an inclined position while said propeller shaft (15) is further inclined downwardly towards the rear by the inclination of said intermediate shaft (32).

4. A marine propulsion unit as claimed in any of claims 1 to 3, wherein one of said external bevel gears (38) is removably mounted on the aft end of said output shaft (21) while the other external bevel gear (39) is formed integrally with said intermediate shaft (32).

5. A marine propulsion unit comprising an engine mounted in the hull of a boat at a stern portion with the output end directed towards the stern, an inclined propeller shaft arranged to extend downwardly and backwardly from the hull and carrying at its terminal end a propeller, and a reversing clutch mechanism disposed between said engine and propeller shaft and having an input shaft drivenly connected to said engine and an output shaft drivingly connected to said propeller shaft, said output shaft being drivenly connected to said input shaft through a speed-reducing gearing, including clutch means, wherein an intermediate shaft (32) is mounted in the transmission path and has its aft end coupled to the fore end of said input shaft (20), the coupled shaft ends being at substantially the same level and coupled together by a pair of substantially equally sized meshing external bevel gears (38, 39) fixedly mounted face to face on said shaft ends such that said input shaft is inclined relative to said intermediate shaft downwardly and backwardly, said intermediate shaft being connected at its fore end to said engine (13) and said reversing clutch mechanism (17) being inclined downwardly towards the rear.

6. A marine propulsion unit as claimed in claim 5, wherein said engine (13) is mounted horizontally and the angle of inclination of said intermediate shaft (32) determines the inclination of said propeller shaft (15).

7. A marine propulsion unit as claimed in claim 5, wherein said engine (13) is mounted in an inclined position while said propeller shaft (15) is further inclined downwardly towards the rear by the inclination of said intermediate shaft (32).

8. A marine propulsion unit as claimed in any of claims 5 to 7, wherein one of said external bevel gears (39) is removably mounted on the fore end of said input shaft (20) while the other external bevel gear (38) is formed integrally with said intermediate shaft (32).

* * * * *